US008895110B2

(12) United States Patent
Takaoka et al.

(10) Patent No.: US 8,895,110 B2
(45) Date of Patent: Nov. 25, 2014

(54) METHOD OF MANUFACTURING SURFACE-COATED CUTTING TOOL WITH EXCELLENT ABRASION RESISTANCE

(75) Inventors: Hidemitsu Takaoka, Naka-gun (JP); Akira Osada, Moriya (JP); Naoki Wakiya, Hamamatsu (JP); Hisao Suzuki, Toyohashi (JP); Kazuo Shinozaki, Inagi (JP)

(73) Assignees: Mitsubishi Materials Corporation, Tokyo (JP); National University Corporaiton Shizuoka University, Shizuoka-Shi (JP); Tokyo Institute of Technology, Tokyo (JP)

( * ) Notice: Subject to any disclaimer, the term of this patent is extended or adjusted under 35 U.S.C. 154(b) by 36 days.

(21) Appl. No.: 13/402,136

(22) Filed: Feb. 22, 2012

(65) Prior Publication Data

US 2012/0219720 A1 Aug. 30, 2012

(30) Foreign Application Priority Data

Feb. 24, 2011 (JP) ..... 2011-038435

(51) Int. Cl.

| | |
|---|---|
| ***B05D 3/02*** | (2006.01) |
| ***B05D 3/10*** | (2006.01) |
| ***C23C 18/12*** | (2006.01) |
| ***C23C 28/04*** | (2006.01) |

(52) U.S. Cl.

CPC ..... *C23C 18/1216* (2013.01); *C23C 18/1254* (2013.01); *C23C 18/1225* (2013.01); *C23C 28/044* (2013.01); *C23C 18/1283* (2013.01); *C23C 18/127* (2013.01); *C23C 18/1295* (2013.01)

USPC ..... 427/380; 427/372.2; 427/343

(58) Field of Classification Search

None

See application file for complete search history.

(56) References Cited

U.S. PATENT DOCUMENTS

| | | | | |
|---|---|---|---|---|
| 5,585,136 | A * | 12/1996 | Barrow et al. | 427/2.24 |
| 6,338,894 | B1 * | 1/2002 | Hirakawa et al. | 428/216 |
| 6,482,476 | B1 * | 11/2002 | Liu | 427/535 |
| 2006/0003187 | A1 * | 1/2006 | Osada et al. | 428/698 |
| 2006/0188747 | A1 * | 8/2006 | Honma et al. | 428/698 |

FOREIGN PATENT DOCUMENTS

| | | |
|---|---|---|
| JP | 2004-124246 | 4/2004 |
| JP | 2006-205558 | 8/2006 |
| JP | 2007-075990 | 3/2007 |

OTHER PUBLICATIONS

Hubert, Thomas, "Wear resistant alumina coatings produced by a sol-gel process", Jan. 2006, Surface & Coatings Tehcnology 201, pp. 487-491.*

(Continued)

*Primary Examiner* — Kelly M Gambetta
*Assistant Examiner* — Ina Agaj
(74) *Attorney, Agent, or Firm* — Leason Ellis LLP.

(57) ABSTRACT

A method of manufacturing a surface-coated cutting tool includes: forming an aluminum oxide layer having a layer thickness of 0.05 to 5 μm and an α-alumina structure with a corundum type crystal structure on a cutting tool body using a sol-gel method. The step of forming includes adding an alcohol to aluminum alkoxide; adding an acid; stirring the mixture at 10° C. or lower to form a sol; applying the sol on a surface of the cutting tool body or an outer-most surface of a hard-coating layer formed on the surface of the cutting tool body; performing a drying process at least once, the applied sol being dried at 100 to 400° C. in the drying process; and annealing the cutting tool body with a dried sol layer at 500 to 1000° C.

6 Claims, 1 Drawing Sheet

(56) References Cited

OTHER PUBLICATIONS

Chen, Yuan-Chun, "Preparation of alpha alumina coating on carbide tools", May 2000, Materials Science and Engineering B77, pp. 221-228.*

European Search Report mailed Jul. 7, 2014 for the corresponding European Application No. 12156485.0.

Kamiya et al. "Formation of α-Alumina Around 500°C in Alkoxy-Derived Alumina Gels Under Ambient Pressure-Effects of Starting Solution Composition and Seeding", *Journal of Sol-Gel Science and Technology*, Springer, New York, NY, US, vol. 20, No. 3, Mar. 2001, pp. 275-285.

* cited by examiner

| Corundum (PDF#46-1212) | | | | ACTUAL VALUE |
|---|---|---|---|---|
| LATTICE SPACING (Å) | h | k | l | LATTICE SPACING (Å) |
| 3.4797 | 0 | 1 | 2 | 3.40 |
| 2.5508 | 1 | 0 | 4 | 2.42 |
| 2.3795 | 1 | 1 | 0 | 2.30 |
| 2.1654 | 0 | 0 | 6 | 2.14 |
| 2.0853 | 1 | 1 | 3 | 2.02 |
| 1.9643 | 2 | 0 | 2 | 1.97 |
| 1.7401 | 0 | 2 | 4 | 1.79 |

METHOD OF MANUFACTURING SURFACE-COATED CUTTING TOOL WITH EXCELLENT ABRASION RESISTANCE

BACKGROUND OF THE INVENTION

1. Field of the Invention

The present invention relates to a method of manufacturing a surface-coated cutting tool with excellent abrasion resistance, and particularly, to a method of manufacturing a surface-coated cutting tool with excellent abrasion resistance in which an aluminum oxide layer is formed by a sol-gel method on the surface of a tool body made of tungsten carbide-based cemented carbide, titanium carbonitride-based cermet, high-speed steel, or a cubic boron nitride-based ultra-high-pressure sintered body (hereinafter, simply referred to as the cutting tool body), or the outer-most surface of a hard-coating film coated on the surface of the cutting tool body.

2. Description of Related Art

Hitherto, it has been known that a hard-coating film made of a carbide, nitride, carbonitride or the like of at least one element selected from the groups IVa, Va and VIa in the periodic table is formed to improve the abrasion resistance of a cutting tool.

Among the hard-coating films, an α-type aluminum oxide layer is formed as the outer-most surface layer of the hard-coating film made of a carbide, nitride, carbonitride or the like of at least one element selected from the groups IVa, Va and VIa in the periodic table in many cases from the viewpoint of excellent thermal stability, low reactivity, and high hardness.

Normally, chemical vapor deposition (CVD) is employed as a method of forming the aluminum oxide layer. However, forming the aluminum oxide layer by physical vapor deposition (PVD) or a sol-gel method is also known.

For example, as shown in Japanese Unexamined Patent Application, First Publication No. 2004-124246, a method of forming an α-type alumina layer under a low-temperature condition (1000° C. or lower) to prevent transformation and deterioration in characteristics of a cutting tool body and a hard-coating film is proposed. In the method, a hard-coating film made of a nitride, carbide, carbonitride, boride, oxynitride or oxycabonitride including, as essential components, Al and at least one element selected from the group consisting of the groups IVa, Va and VIa and Si is formed by physical vapor deposition (PVD) on the surface of a cutting tool body. Then the hard-coating film is oxidized to form an oxide-containing layer. As a result, an alumina layer essentially having an α-type crystal structure and excellent in abrasion resistance and heat resistance as an outer-most layer is deposited on the oxide-containing layer by physical vapor deposition (PVD).

In addition, as shown in Japanese Unexamined Patent Application, First Publication No. 2007-75990, a surface-coated cutting tool having a hard-coating layer deposited thereon by physical vapor deposition (PVD) is proposed. In the surface-coated cutting tool, the first layer is constituted by a (Ti,Al)N layer and the second layer is constituted by an aluminum oxide layer (preferably, γ-type alumina layer).

Furthermore, as shown in Japanese Unexamined Patent Application, First Publication No. 2006-205558, a method of manufacturing an aluminum oxide-coated structure with excellent mechanical characteristics and durability is proposed. In the method, a base material is coated with the first alumina layer formed of alumina having an amorphous crystal structure, alumina having a γ-type structure, or a mixture thereof by a sol-gel method, and the second alumina layer essentially having γ-type is formed by sputtering.

By using the above-described conventional surface-coated cutting tools (hereinafter, simply referred to as the coated tools), which are coated with the hard-coating film and an aluminum oxide layer formed on the outer-most surface of the hard-coating film, abrasion resistance on the rake face of the coated cutting tool is improved in the steel cutting or the like. The reason for the improvement is that α-type alumina has high heat stability and non-reactiveness.

Japanese Unexamined Patent Application, First Publication No. 2004-124246 proposes the formation of an α-type alumina layer under low-temperature conditions by physical vapor deposition (PVD). In the deposition of the aluminum oxide layer, the hard-coating layer needs to be oxidized first to form the oxide-containing layer on the surface of the oxidized hard-coating layer. However, in the aluminum oxide layer by the PVD method, adhesion between the oxide-containing layer and the aluminum oxide layer is not sufficient. In addition, as the aluminum oxide, the γ-type alumina is also present in addition to the α-type alumina. Because of these problems, sufficient heat resistance is not obtained. As a result, the cutting tool with an α-type alumina layer deposited by PVD cannot show sufficient cutting performance for a long time period of use.

In addition, in Japanese Unexamined Patent Application, First Publication No, 2007-75990 and Japanese Unexamined Patent Application, First Publication No. 2006-205558, since the formed aluminum oxide is γ-alumina, stability at high temperature is poor, and during high-speed cutting, satisfactory cutting performance cannot be exhibited.

SUMMARY OF THE INVENTION

Accordingly, the inventor of the invention have performed intensive studies on a sol-gel method for forming an outer-most layer of a hard-coating layer which is formed by physical vapor deposition (PVD) on the surface of a cutting tool body. The inventor found that an aluminum oxide layer having an α-type crystal structure can be formed as the outer-most layer by using an alumina sol preparation. The alumna sol preparation is subjected to a long-term aging treatment under low-temperature conditions.

What is found is explained in detailed below. The rate of hydrolysis reaction is reduced when the solution for sol preparation is stirred at lower temperature than usual, and an aging treatment is performed in an alumina sol preparation process. Because of the reduced rate of hydrolysis reaction, precursors of aluminum oxide having the Al—O bonding are formed densely. As a result, crystallization of α-type alumina is enhanced. Thusly, by drying and annealing the cutting tool body applied with the sol, the aluminum oxide layer with the corundum type crystal structure is formed as the outer-most layer of the hard-coating film.

In addition, when the hard-coating film brought into contact with the aluminum oxide layer on the outer-most layer is formed as a nitride coating in which the content of Al in metal components in the hard coating is 40 at % or greater, the adhesion strength of the hard-coating film with the aluminum oxide layer on the outer-most layer increases. Therefore, usage of the nitride coating is preferable since occurrence of peeling, fracturing, or the like of the aluminum oxide layer caused from impacts or the like during cutting operation can be prevented.

In addition, it is found that in a surface-coated cutting tool manufactured by a method of the present invention, the surface of the aluminum oxide layer on the outer-most surface is flat and smooth. Thus, the tool has excellent resistance to welding metal deposition. As a result, it exhibits excellent abrasion resistance for a long time period of use.

The invention is contrived on the basis of the above-described findings. Aspects of the present invention are shown below.

(1) A method of manufacturing a surface-coated cutting tool with excellent abrasion resistance comprising the step of: forming an aluminum oxide layer having a layer thickness of 0.05 to 5 μm and an α-alumina structure with a corundum type crystal structure on a cutting tool body, which is made of tungsten carbide-based cemented carbide, titanium carbonitride-based cermet, high-speed steel, or cubic boron nitride-based ultrahigh-pressure sintered body, using a sol-gel method, wherein the step of forming the aluminum oxide layer comprises the steps of: adding an alcohol to aluminum alkoxide to prepare a mixture; adding an acid to the mixture after the step of adding an alcohol; stirring the mixture at 10° C. or lower to form a sol after the step of adding an acid; performing application and drying of the sol at least once; and annealing the cutting tool body with a dried sol layer at 500 to 1000° C., wherein the sol is applied on a surface of the cutting tool body or an outer-most surface of a hard-coating layer formed on the surface of the cutting tool body in the application of the sol; and the applied sol is dried at 100 to 400° C. in the drying of the sol.

(2) The method of manufacturing a surface-coated cutting tool with excellent abrasion resistance described in the above-mentioned (1), further including the step of: coating the surface of the cutting tool body with nitride containing one or more elements selected from the group consisting of elements belonging to the IVa, Va, and VIa groups in the periodic table, Al, and Si, as a hard-coating layer by a physical vapor deposition method, a chemical vapor deposition method, or a sol-gel method, wherein the aluminum oxide layer is formed on the outer-most surface of the hard-coating layer.

(3) The method of manufacturing a surface-coated cutting tool with excellent abrasion resistance described in the above-mentioned (1), wherein the surface of the tool body is subjected to a plasma nitriding treatment in advance.

(4) The method of manufacturing a surface-coated cutting tool with excellent abrasion resistance described in any one of the above-mentioned (1) to (3), wherein α-alumina particles with an average diameter of 10 to 300 nm are added to the mixture together with the acid in the step of adding acid during formation of the sol out of the aluminum alkoxide, the alcohol, and the acid.

Hereinafter, embodiments of the present invention are explained in detail.

In a method of manufacturing a surface-coated cutting tool of an embodiment of the present invention, an aluminum oxide layer having an α-alumina structure with a corundum crystal structure is directly formed by a sol-gel method on the surface of a cutting tool body made of tungsten carbide-based cemented carbide, titanium carbonitride-based cermet, high-speed steel, or a cubic boron nitride-based ultra-high-pressure sintered body.

In addition, in the method of manufacturing a surface-coated cutting tool of an embodiment of the present invention, at least one hard-coating film (for example, TiAlN film, CrAlN film and the like), which is already known to those skilled in the art, is coated on the surface of the cutting tool body. The hard-coating film is made of a nitride containing Al and at least one element selected from Si and elements belonging to the groups IVa, Va and VIa in the periodic table by physical vapor deposition (PVD). After forming of the hard-coating film(s), an aluminum oxide layer having α-aluminum structure with a corundum crystal structure can be formed on the outer-most surface of the hard coating film by a sol-gel method.

In the formation of a hard-coating layer by physical vapor deposition (PVD), it is preferable that the hard-coating film brought into contact with the aluminum oxide layer be coated as a nitride coating film in which the content of Al in metal components in the hard-coating film is 40 at % or greater from the viewpoint that adhesion is increased.

The reason for this is that when the hard-coating film is a nitride coating film in which the content of Al in metal components in the hard-coating film is 40 at % or greater, an oxide having a high aluminum concentration is formed at the interface between the nitride coating film and the aluminum oxide coating film. Existence of the oxide makes adhere of the nitride coating to the aluminum oxide coating stronger.

An aluminum oxide layer forming process by a sol-gel method of an embodiment of the present invention is as follows in detail.

Preparation of Alumina Sol:

First, alcohol (for example, ethanol, methanol or 1-butanol) is added to alkoxide of aluminum (for example, aluminum sec-butoxide or aluminum propoxide), and acid (for example, dilute hydrochloric acid or dilute nitric acid) is further added (at the same time, α-alumina particles having an average diameter of 10 to 300 nm may be added). Then, the materials are stirred in a temperature range of 10° C. or lower, and for example, aged for 12 hours or longer to form an alumina sol.

When the average diameter of the α-alumina particles is less than 10 nm, aggregation easily occurs and the dispersion state thus deteriorates. On the other hand, when the average diameter of the particles is greater than 300 nm, the dispersion state in the sol deteriorates and defects may occur during incorporation into the coating film. Accordingly, the average diameter of the α-alumina particles to be added is in the range of 10 to 300 nm.

In addition, it is preferable that the concentration of the acid added be in the range of 0.01 to 1.0 N, and the amount of the acid added be in the range of 0.5 to 5 times (volume) that of the alcohol.

In the normal alumina sol preparation, the stirring is performed at a temperature of 40° C. to 80° C. and an aging treatment is performed for about several hours at the temperature. However, in this embodiment of the present invention, the stirring is performed at a low temperature of 10° C. or lower, and for example, the aging treatment is performed over a long time of 12 hours or longer.

Here, when the temperature of the sol is higher than 10° C. during stirring, hydrolysis reaction excessively proceeds, and thus α-alumina is not formed in the annealing process in a downstream process. Accordingly, the temperature during stirring is adjusted to a low-temperature range of 10° C. or lower.

The reason for the long aging time of 12 hours or longer is to gradually promote the hydrolysis reaction at a low temperature to thereby densely form the aluminum oxide precursor.

There is no particular limitation for the lower limit of the temperature in the stirring as long as the alcohol is not frozen. However, if the temperature is too low, time needed for the aging process becomes too long, reducing productivity. Therefore, it is preferable to set the lower limit of the temperature in the stirring and ageing processes at −30° C. More preferable lower limit of the temperature is −18° C.

Drying and Annealing:

The prepared alumina sol is directly applied to the surface of a cutting tool body, or applied to the outer-most surface of a hard-coating film which is coated on the surface of the cutting tool body by physical vapor deposition (PVD). Next, a drying of the sol is performed in a temperature range of 100° C. to 400° C. and a annealing treatment is performed in a temperature range of 500° C. to 1000° C. to form an aluminum oxide layer. The above-mentioned application and drying of the sol are repeated at least once.

By the above-described drying treatment, the dried alumina gel is formed, and by the subsequent annealing treatment, the aluminum oxide layer having an α-alumina structure with a corundum crystal structure is formed on the surface of the hard coating film.

The thickness of the aluminum oxide layer depends on the thickness of the applied alumina sol and the frequency of application. However, when the thickness of the formed aluminum oxide layer is less than 0.05 μm, the surface-coated tool cannot exhibit excellent abrasion resistance over long-term usage. Also, when the thickness is greater than 5 μm, the aluminum oxide layer is easily peeled off. Therefore, the thickness of the aluminum oxide layer is set in the range of 0.05 to 5 μm.

In addition, the respective reasons for the drying treatment temperature range of 100° C. to 400° C. and the annealing treatment temperature range of 500° C. to 1000° C. are that when the drying temperature is lower than 100° C., sufficient drying cannot be performed, and when the drying temperature is higher than 400° C., the annealing proceeds at the same time, and thus cracks and the like are formed on the coating film and the coating film is easily peeled off, and that when the annealing temperature is lower than 500° C., an aluminum oxide layer having crystallinity sufficient for cutting is not formed, and when the annealing is performed at a temperature higher than 1000° C., although there is no particularly large problem, the hard-coating film such as (Ti,Al)N formed as a hard-coating film is decomposed or oxidized, the cemented carbide, the cermet body or the like is oxidized, whereby no advantages of the low-temperature film formation are shown.

The aluminum oxide layer can exhibit its performance when it is directly formed on the cutting tool body without any specific treatments on the surface. However, when cemented carbide, titanium carbonitride-based cermet or high-speed steel is used as a body, the surface of a cutting tool body can be subjected to a plasma nitriding treatment in advance to nitride metal bonding phase near the surface of the tool to thereby harden the surface, and the aluminum oxide layer is formed on the surface thereof. In this manner, the adhesion strength between the aluminum oxide layer and the cutting tool body increases and the lifetime of the cutting tool is extended.

According to a method of manufacturing a surface-coated cutting tool of an aspect of the present invention (hereinafter referred as the method of manufacturing a surface-coated cutting tool of the present invention), an aluminum oxide layer having an α-alumina structure with a corundum crystal structure is directly formed on the surface of a cutting tool body or on the outer-most surface of a hard-coating film, which is coated by physical vapor deposition (PVD), by the sol-gel method. The formed aluminum oxide layer has excellent resistance to welding metal deposition and abrasion resistance. In addition, since the aluminum oxide layer formed on the outer-most surface as the hard coating film has excellent adhesion strength with the hard coating film, the surface-coated cutting tool produced by the method of the present invention exhibits excellent cutting performance over long-term usage and the lifetime of the cutting tool is extended.

DETAILED DESCRIPTION OF THE INVENTION

Figures 1A, 1B:
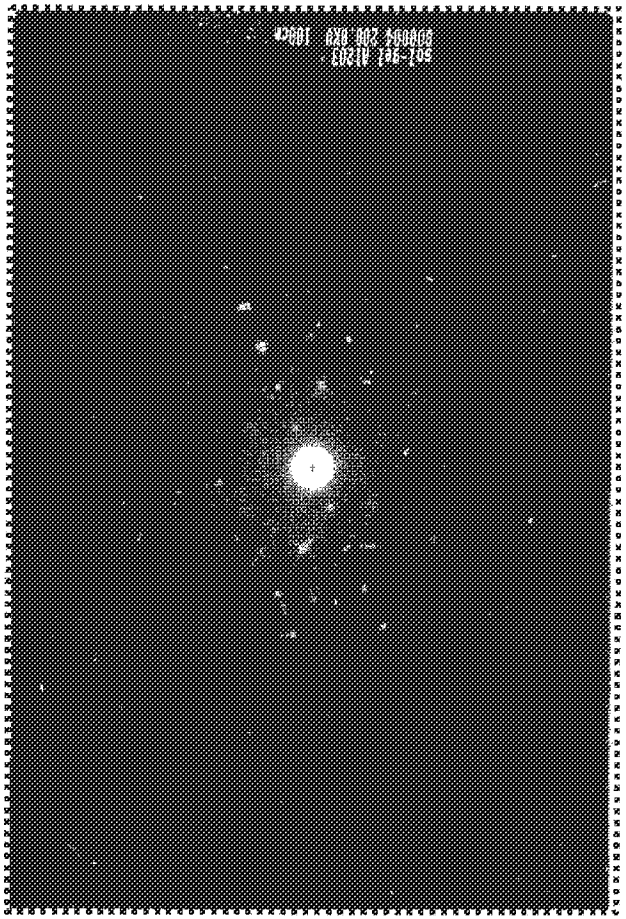
FIG. 1A shows an electron beam diffraction pattern of an aluminum oxide layer of a surface-coated cutting tool (the cutting tool 1 of the present invention) which is produced by the method of the present invention
FIG. 1B shows the results of the analysis on the pattern and the actual measured values of lattice spacing.

Next, the invention will be explained in detail using the examples.

Example 1

As raw material powders, WC powder, TiC powder, ZrC powder, VC powder, TaC powder, NbC powder, $Cr_3C_2$ powder, TiN powder, TaN powder, and Co powder were prepared. Particles in each powder have an average diameter of 1 to 3 μm. The powders were mixed with predetermined mixing compositions, and wax was further added and mixed for 24 hours by ball milling. The resultant materials were dried under reduced pressure and then press-molded into green compacts having predetermined shape at a pressure of 98 MPa. The green compacts were vacuum-sintered under conditions of being held under a vacuum of 5 Pa at a predetermined temperature of 1370° C. to 1470° C. for 1 hour. Then cutting edge portions were honed (R: 0.07 mm). Whereby, the cutting tool bodies A, B, C, and D made of WC-based cemented carbide (referred to as the cemented carbide bodies A, B, C, and D) and having an insert shape defined in ISO CNMG 120408 were manufactured.

(a) Next, the cemented carbide body A was inserted into an arc ion plating facility, which is a kind of physical vapor deposition equipment, to coat a hard-coating film made of a $Ti_{0.5}Al_{0.5}N$ layer having a thickness of 2.0 μm by physical vapor deposition.

The cemented carbide body B was also inserted into the same arc ion plating facility to coat a hard-coating film made of an $Al_{0.7}Cr_{0.3}N$ layer having a thickness of 2.0 μm by physical vapor deposition.

The cemented carbide body C was inserted into a plasma nitriding furnace. The substrate was heated at 600° C., and a DC voltage of −300 V was applied to the substrate at a pressure of 200 Pa in a flow of ammonia and hydrogen (flow rate ratio 1:4) to perform a plasma nitriding treatment for about 1 hour.

(b) Alumina sol preparation for forming an aluminum oxide layer on the outer-most surface of a hard-coating film by a sol-gel method was performed as follows.

As alcohol, 586 ml of ethanol was added to 123 g of aluminum sec-butoxide which is alkoxide of aluminum, to prepare a mixture. Then the mixture was stirred at 0° C. in a thermostatic bath, and 0.2 N-dilute hydrochloric acid was dripped to the mixture for 1 hour.

(c) The resultant material was held at 0° C. in the thermostatic bath and continuously stirred for 12 hours. Furthermore, the stirred material was aged for 24 hours at 3° C., whereby an alumina sol was prepared.

The final solution composition was adjusted to be the molar ratio of 1:50:20:1 (aluminum sec-butoxide:water:ethanol:hydrochloric acid).

(d) The alumina sol was applied to the hard-coating film made of the $Ti_{0.5}Al_{0.5}N$ layer coated on the cemented carbide body A, the hard-coating film made of the $Al_{0.7}Cr_{0.3}N$ layer coated on the cemented carbide body B, the cemented carbide body C, which is subjected to the plasma nitriding treatment, and the cemented carbide body D, which is not subjected to a particular surface treatment.

(e) Next, the applied alumina sol was dried for 0.5 hours at 300° C. in the air, and the application and the drying were repeated a total of five times. Then, the resultant material was fired for 1 hour at 600° C. in the air to form a 1-μm thickness aluminum oxide layer having an α-alumina structure with a corundum crystal structure on the outer-most surface. Thus, surface-coated cutting tools 1, 2, 3, and 4 (referred to as the cutting tools 1, 2, 3, and 4 of the present invention) were manufactured.

The structures of the aluminum oxide layers of the cutting tools 1 to 4 of the present invention were analyzed using a transmission electron microscope. It was confirmed that the aluminum oxide layer has an α-alumina structure with a corundum crystal structure.

FIG. 1A shows an electron beam diffraction pattern of the aluminum oxide layer of the cutting tool 1 of the present invention as an example. FIG. 1B shows the results of the analysis and the actual measured values of lattice spacing, FIG. 1B also shows the standard lattice spacing of α-alumina having a corundum crystal structure.

Based on the results of FIGS. 1A and 1B, it was confirmed that the aluminum oxide layer of the cutting tool 1 of the present invention has an α-alumina structure with a corundum crystal structure.

Comparative Example 1

Surface-coated cutting tools were produced by the following method for comparison.

Hard coating films were coated on the tool bodies A, B, C, and D by the process (a), and an alumina sol was prepared by the above-described process (b).

Next, in place of the process (c), the materials were held at 40° C. in a thermostatic bath and continuously stirred for 12 hours. Furthermore, the stirred material was aged for 24 hours at 40° C., whereby an alumina sol was prepared.

Next, in the same manner as in (d), the alumina sol was applied to the hard coating layer made of the $Ti_{0.5}Al_{0.5}N$ layer coated on the cemented carbide body A, the hard coating layer made of the $Al_{0.7}Cr_{0.3}N$ layer coated on the cemented carbide body B, the cemented carbide body C, which is subjected to the plasma nitriding treatment, and the cemented carbide body D, which is not subjected to a particular surface treatment.

Next, the applied alumina sol was dried in the same manner as in (e) for 0.5 hours at 300° C. in the air, and the application and the drying were repeated a total of five times. Then, the resultant material was fired for 1 hour at 600° C. in the air to form a 1-μm thickness aluminum oxide layer on the outer-most surface. Thus, surface-coated cutting tools 1, 3, and 4 (comparative cutting tools 1, 2, 3, and 4) of the comparative examples were manufactured.

The structures of the aluminum oxide layers of the comparative cutting tools 1 to 4 were analyzed using a transmission electron microscope, and it was confirmed that the aluminum oxide layer has an amorphous structure without a particular crystal structure.

A carbon steel cutting test was performed with the cutting tools 1 to 4 of the present invention and the comparative cutting tools 1 to 4 under the following conditions.

Workpiece: Round Bar of JIS S45C
Cutting Speed: 200 m/min
Depth of Cut: 2.0 mm
Feeding: 0.2 mm/rev
Cutting Time: 3 minutes After the cutting test, the wear states of the tools were observed to measure frank wear widths.

The results are shown in Table 1.

TABLE 1

| Type | | Cutting tool body symbol | Frank wear width (mm) | Type | | Cutting tool body symbol | Abrasion State |
|---|---|---|---|---|---|---|---|
| Cutting tool of the present invention | 1 | A | 0.11 | Comparative cutting tool | 1 | A | Fracturing due to abrasion on rake face after 1.8 minutes |
| | 2 | B | 0.09 | | 2 | B | Fracturing due to abrasion on rake face after 2.4 minutes |
| | 3 | C | 0.15 | | 3 | C | Fracturing due to abrasion on rake face after 0.3 minutes |
| | 4 | D | 0.18 | | 4 | D | Fracturing due to abrasion on rake face after 0.2 minutes |
| | 5 | E | 0.12 | | 5 | E | Fracturing due to abrasion on rake face after 1.8 minutes |
| | 6 | F | 0.15 | | 6 | F | Fracturing due to abrasion on rake face after 1.5 minutes |
| | 7 | G | 0.07 | | 7 | G | Fracturing due to abrasion on rake face after 3.2 minutes |
| | 8 | H | 0.08 | | 8 | H | Fracturing due to abrasion on rake face after 1.6 minutes |
| | 9 | I | 0.12 | | 9 | I | Fracturing due to abrasion on rake face after 0.3 minutes |

Example 2

As raw material powders, TiCN powder (TiC/TiN=50/50 in terms of mass ratio), $Mo_2C$ powder, ZrC powder, NbC powder, TaC powder, WC powder, Co powder, and Ni powder were prepared. Particles in each powder have an average diameter of 0.5 to 2 μm. The powders were mixed with a predetermined mixing composition, and a wax was further added and mixed for 24 hours by ball milling. The resultant materials were dried under reduced pressure and then press-molded into green compacts having a predetermined shape at a pressure of 98 MPa. The green compacts were sintered under conditions of being held under a nitrogen atmosphere of 1.3 kPa at a temperature of 1540° C. for 1 hour. Then cutting edge portions were honed (R: 0.07 mm). Whereby, tool bodies E and F made of TiCN-based cermet (referred to as the cermet bodies E and F) and having a chip shape of ISO CNMG 190612 were manufactured.

(g) Next, the cermet body E was inserted in an arc ion plating facility, which is a kind of physical vapor deposition equipment to coat a hard-coating layer made of a $Ti_{0.5}Al_{0.5}N$ layer having a thickness of 2.0 μm by physical vapor deposition.

In addition, the cermet body F was also inserted into the same arc ion plating facility to coat a hard-coating layer made of an $Al_{0.7}Cr_{0.3}N$ layer having a thickness of 2.0 μm by physical vapor deposition.

(h) Alumina sol for forming an aluminum oxide layer on the outer-most surface of the hard-coating film by a sol-gel method was prepared as follows.

As alcohol, 915 ml of 1-butanol was added to 102 g of aluminium isopropoxide which is alkoxide of aluminum, to prepare a mixture. Then the mixture was stirred at 0° C. in a thermostatic bath, and α-alumina particles having an average diameter of 100 nm were added to be 4 wt % with respect to the aluminium isopropoxide. Furthermore, 0.2 N-dilute nitric acid dripped to the mixture for 1 hour.

(i) The material was held at 0° C. in the thermostatic bath and continuously stirred for 12 hours. Furthermore, the stirred material was aged for 24 hours at 3° C., whereby an alumina sol was prepared.

The final solution composition was adjusted to be the molar ratio of 1:50:20:1 (aluminum isopropoxide:water:1-butanol: nitric acid).

(j) The alumina sol was applied to the hard coating film made of the $Ti_{0.5}Al_{0.5}N$ layer coated on the cermet body E and the hard coating layer made of the $Al_{0.7}Cr_{0.3}N$ layer coated on the cermet body F.

(k) Next, the applied alumina sol was dried for 0.5 hours at 300° C. in the air, and the application and the drying were repeated a total of four times. Then, the resultant material was fired for 1 hour at 600° C. in the air to form a 1-μm thickness aluminum oxide layer having an α-alumina structure with a corundum crystal structure on the outer-most surface. Thus, surface-coated cutting tools 5 and 6 of the present invention (the cutting tools 5 and 6 of the present invention) were manufactured.

In addition, as raw material powders, TiN powder, TiC powder, TiCN powder, $TiAl_3$ powder, $Al_2O_3$ powder, WC powder, and cBN powder were prepared. Particles in each powder have an average diameter of 0.3 to 0.9 μm. The powders were mixed with a predetermined mixing composition. The mixture of the materials was wet-mixed for 48 hours by a ball mill and dried. Then, the resultant material was press-molded into the dimensions of 50 mm (diameter)×1.5 mm (thickness) by a hydraulic press at a molding pressure of 1 MPa. The green compact was held for 30 to 60 minutes at a predetermined temperature of 1000° C. to 1300° C. in a vacuum atmosphere of a pressure of 1 Pa to be heat-treated, and volatile components and components adsorbed on the surface of the powder were removed to form a pre-sintered body for a cutting edge piece. The pre-sintered body was combined with a separately prepared support piece made of WC-based cemented carbide and having a composition of 8 mass % of Co and the balance WC and dimensions of 50 mm (diameter)×2 mm (thickness), and was inserted into a normal ultra-high pressure sintering device to be subjected to ultra-high pressure and high-temperature sintering under normal conditions of a pressure of 5 GPa, a temperature of 1500° C., and a holding time of 30 minutes. Whereby, a cBN sintered material was obtained. The annular cBN sintered material plate was cut into predetermined dimensions by a wire electric discharge machine, and was brazed to a brazing portion (corner portion) of an insert body made of WC-based cemented carbide and having a composition of 5 mass % of Co, 5 mass % of TaC and the balance WC and an insert shape of ISO CNGA 120408 by using a brazing filler metal of Ag alloy having a composition of 26% of Cu, 5% of Ti, and the balance Ag in terms of mass %. Then, abrasion of upper and lower surfaces and the outer circumference and a honing treatment were performed thereon, and thus cutting tool bodies G, H, and I made of a cBN sintered body having an insert shape of ISO CNGA 120408 were manufactured.

By the processes (g) to (k), hard coatings were formed on the tool bodies G and H. The cutting tool body I was not subjected to any treatment. Then, an alumina film was formed on each of the surfaces thereof to manufacture surface-coated cutting tools 7, 8, and 9 (referred to as the cutting tools 7, 8, and 9 of the present invention) of the present invention.

The structures of the aluminum oxide layers of the cutting tools 5 to 9 of the present invention were analyzed using a transmission electron microscope, and it was confirmed that the aluminum oxide layer has an α-alumina structure with a corundum crystal structure.

Comparative Example 2

Comparative surface-coated cutting tools 5 to 9 (referred to as the comparative cutting tools 5 to 9) were manufactured using the tool bodies E to I for comparison.

That is, by the process (g), a hard-coating film made of a $Ti_{0.5}Al_{0.5}N$ layer was coated on the cermet body E, a hard-coating film made of an $Al_{0.7}Cr_{0.3}N$ layer was coated on the cermet body F, a hard-coating film made of a $Ti_{0.5}Al_{0.5}N$ layer was coated on the cutting tool body G made of a cBN sintered body, and a hard-coating film made of an $Al_{0.7}Cr_{0.3}N$ layer was coated on the cutting tool body H made of a cBN sintered body. The cutting tool body I made of a cBN sintered body was not subjected to any treatment, and an alumina sol was prepared by the process (h).

Next, in the process (i), the materials was held at 40° C. in the thermostatic bath and continuously stirred for 12 hours. Furthermore, the stirred material was aged for 24 hours at 40° C., whereby an alumina sol was prepared.

Next, the alumina sol was applied to the hard coating films coated on the cermet bodies E and F and the tool bodies G and H made of a cBN sintered body, and on the non-treated cutting tool body I made of a cBN sintered body.

Next, the applied alumina sol was dried in the same manner as in (k) for 0.5 hours at 300° C. in the air, and the application and the drying were repeated a total of five times. Then, the resultant material was fired for 1 hour at 600° C. in the air to form a 1-μm thickness aluminum oxide layer on the outer-most surface. Thus, comparative surface-coated cutting tools 5 to 9 (comparative cutting tools 5 to 9) of the comparative examples were manufactured.

The structures of the aluminum oxide layers of the comparative cutting tools 5 to 9 were analyzed using a transmission electron microscope, and it was confirmed that the aluminum oxide layer has an amorphous structure.

A carbon steel cutting test was performed with the cutting tools 5 and 6 of the present invention and the comparative cutting tools 5 and 6 under the following conditions.

Workpiece: Round Bar of JIS S45C
Cutting Speed: 200 m/min
Depth of Cut: 2.0 mm
Feeding: 0.2 min/rev
Cutting Time: 3 minutes After the cutting test, the wear states of the tools were observed to measure frank wear widths.

In addition, hardened steel cutting test was performed with the cutting tools 7, 8, and 9 of the present invention and the comparative cutting tools 7, 8, and 9 under the following conditions.

Workpiece: Round Bar of JIS SUJ2 (HRA60)
Cutting Speed: 220 m/min
Depth of Cut: 0.15 mm
Feeding: 0.25 mm/rev
Cutting Time: 5 minutes After the cutting test, the wear states of the tools were observed to measure flank wear widths.

Table 1 shows the observation results of the abrasion damage states of the tools after the cutting tests.

Based on the results shown in Table 1, it was demonstrated that the aluminum oxide layer on the outer-most surface was configured as an aluminum oxide layer which is excellent in smoothness and has an α-alumina structure with a corundum crystal structure and a thickness of 0.05 to 5 μm, in the cutting tools 1 to 9 of the present invention, which were manufactured by the method of the present invention. Therefore, excellent abrasion resistance is exhibited over long-term use without occurrence of welding.

On the other hand, it was demonstrated that fracturing occurred on the cutting edge or the rake face was severely damaged during the cutting operation in the comparative cutting tools 1 to 9 in which the aluminum oxide layer on the outer-most surface had a γ-alumina structure. Accordingly, it is obvious that the abrasion resistance deteriorates and the tool-life is reached in a short period of time.

According to the method of manufacturing a surface-coated cutting tool of the present invention, by a sol-gel method including the preparation of an alumina sol in a relatively low temperature range, an aluminum oxide layer which has an α-alumina structure with a corundum crystal structure and is excellent in thermal stability and abrasion resistance can be formed with a simple operation. Accordingly, the invention contributes not only to extension of the lifetime of the cutting tool, but also to resource saving and energy saving in the manufacturing process, thereby having great practical advantages.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A method of manufacturing a surface-coated cutting tool with excellent abrasion resistance comprising the step of:

forming an aluminum oxide layer having a layer thickness of 0.05 to 5 μm and an α-alumina structure with a corundum type crystal structure on a cutting tool body, which is made of tungsten carbide-based cemented carbide, titanium carbonitride-based cermet, high-speed steel, or cubic boron nitride-based ultrahigh-pressure sintered body, using a sol-gel method, wherein the step of forming the aluminum oxide layer comprises the steps of:

adding alcohol to aluminum alkoxide to prepare a mixture;

adding acid to the mixture after the step of adding alcohol;

stirring the mixture at 10° C. or lower to form a sol after the step of adding acid;

performing application on the cutting tool body and drying of the sol at least once, thereby creating a dried sol layer; and annealing the cutting tool body with the dried sol layer at a temperature in a range between 500 and 600° C., wherein the sol is applied on a surface of the cutting tool body or an outer-most surface of a hard-coating layer formed on the surface of the cutting tool body in the application of the sol; and the applied sol is dried at 100 to 400° C. in the drying of the sol.

2. The method of manufacturing a surface-coated cutting tool with excellent abrasion resistance according to claim 1, further comprising the step of:

coating the surface of the cutting tool body with nitride containing one or more elements selected from the group consisting of elements belonging to the IVa, Va, and Via groups in the periodic table, Al, and Si, as a hard-coating layer by a physical vapor deposition method, a chemical vapor deposition method, or a sol-gel method, wherein the aluminum oxide layer is formed on the outer-most surface of the hard-coating layer.

3. The method of manufacturing a surface-coated cutting tool with excellent abrasion resistance according to claim 1, wherein the surface of the tool body is subjected to a plasma nitriding treatment in advance.

4. The method of manufacturing a surface-coated cutting tool with excellent abrasion resistance according to claim 1, wherein α-alumina particles with an average diameter of 10 to 300 nm are added to the mixture together with the acid in the step of adding acid during formation of the sol out of the aluminum alkoxide, alcohol, and the acid.

5. The method of manufacturing a surface-coated cutting tool with excellent abrasion resistance according to claim 2, wherein α-alumina particles with an average diameter of 10 to 300 nm are added to the mixture together with the acid in the step of adding acid during formation of the sol out of the aluminum alkoxide, alcohol, and the acid.

6. The method of manufacturing a surface-coated cutting tool with excellent abrasion resistance according to claim 3, wherein α-alumina particles with an average diameter of 10 to 300 nm are added to the mixture together with the acid in the step of adding acid during formation of the sol out of the aluminum alkoxide, alcohol, and the acid.

* * * * *